US007185536B2

(12) United States Patent
Butler et al.

(10) Patent No.: US 7,185,536 B2
(45) Date of Patent: Mar. 6, 2007

(54) PRESSURE MONITORING TECHNIQUE FOR DOWNHOLE TOOLS

(76) Inventors: Thomas L. Butler, 608 Montclair, Refugio, TX (US) 78377; T. Glen Butler, 1509 Crestview, Portland, TX (US) 78374

( * ) Notice: Subject to any disclaimer, the term of this patent is extended or adjusted under 35 U.S.C. 154(b) by 0 days.

(21) Appl. No.: 11/126,715

(22) Filed: May 11, 2005

(65) Prior Publication Data

US 2005/0199053 A1 Sep. 15, 2005

Related U.S. Application Data

(62) Division of application No. 10/453,214, filed on Jun. 3, 2003, now Pat. No. 6,910,375.

(51) Int. Cl.
*E21B 47/06* (2006.01)
*F04B 51/00* (2006.01)

(52) U.S. Cl. ..... 73/152.55; 73/152.62; 73/168

(58) Field of Classification Search ..... 73/152.51, 73/152.55, 152.62, 168
See application file for complete search history.

(56) References Cited

U.S. PATENT DOCUMENTS 3,749,185 A 7/1973 Tiraspolsky et al.
4,297,880 A 11/1981 Berger
6,109,367 A 8/2000 Bischel et al.
6,421,298 B1 7/2002 Beattie et al.

*Primary Examiner*—Daniel S. Larkin
(74) *Attorney, Agent, or Firm*—G. Turner Moller

(57) ABSTRACT

The outlet pressure of a pump that fluctuates rapidly, as is typical of high pressure multiplex pumps, is sensed in a pressure line leading from the main flow line to a damping mechanism. The damping mechanism comprises a pair of small spaced openings, which are preferably adjustable in size. The damping mechanism is ideally a pair of needle valves placed in series so the pressure downstream of the second needle valve fluctuates considerably less than upstream of the first needle valve. The damped pressure is sensed to provide an input to real time graphs showing various pertinent pressure measurements involving the application of pressure, e.g. to monitor downhole tools in hydrocarbon wells. The downhole tools may be fluid driven motors, whipstocks, packers, wiper plugs and the like. In the case of fluid driven or mud motors, a base line pressure taken when the motor is idling is compared to the pressure when the motor is drilling to detect the onset of motor stall.

11 Claims, 3 Drawing Sheets

PRESSURE MONITORING TECHNIQUE FOR DOWNHOLE TOOLS

This is a divisional application of Ser. No. 10/453,214, filed Jun. 3, 2003, entitled PRESSURE MONITORING TECHNIQUE AND APPLICATIONS INVOLVING WELLS, now U.S. Pat. No. 6,910,375.

This invention relates to a method and apparatus for monitoring pressure and, more particularly, to applications of pressure monitoring in hydrocarbon wells.

BACKGROUND OF THE INVENTION

The equipment used in drilling, completion and working over of hydrocarbon wells in the past has almost entirely been a matter of brute force rather than finesse. Drilling rigs in particular and workover rigs to a lesser extent are characterized by massive machinery, high horsepower pumps and a brute force approach to problems. In contrast, coiled or spooled tubing units are much more finesse oriented because the pipe that comprises the work string is much smaller, much thinner and much less capable of accommodating large forces. At one time, coiled tubing units were widely known as an invitation to a fishing job because there were so many mechanical failures of the work string or the loss of bottom hole components in wells.

It is a tribute to the manufacturers of coiled tubing and coiled tubing equipment and a tribute to operators of coiled tubing equipment that the reliability of coiled tubing operations has increased dramatically over the years. In addition, the relative attractiveness of coiled tubing operations as compared to conventional workover rig operations has improved substantially to the extent that coiled tubing units have taken considerable market share from workover rigs in the completion and reworking of hydrocarbon wells.

So called pressure snubbers are known in the art and are used between a fluctuating pressure source and a gauge to protect the gauge from pressure spikes and to damp pressure fluctuations. These devices comprise a fitting having a porous metal insert or a single perforation. A gauge or pressure sensor is threaded into the fitting.

Relevant to this invention are the disclosures in U.S. Pat. Nos. 3,749,185; 4,297,880; 6,109,367 and 6,421,298.

SUMMARY OF THE INVENTION

In one aspect of this invention, a pressure source, such as a pump, provides an output pressure that fluctuates widely and rapidly. In order to provide pressure sensings that are meaningful, a pressure measuring conduit connects to the pressure source and includes a damper, leaving the main flow line of the pressure source undamped. The damper reduces the fluctuations of the output pressure to less than 1% of the average outlet pressure and preferably much less. The damped pressure is sensed by a conventional sensor and displayed on a screen in real time so the user can make decisions based on the damped pressure sensings. The values are preferably displayed as time versus damped pressure so the trends may be readily seen and action taken in response to the trends seen. This is particularly important when actions occur in response to pressure differentials that are smaller than or masked by the pressure fluctuations. This situation may occur in many environments, such as in the use of downhole tools in hydrocarbon wells which are powered or manipulated by hydraulic pressure supplied from the surface. Many other applications will become apparent to those skilled in the art.

In another aspect of this invention, a particularly effective and inexpensive damper is described, comprising a pair of needle valves in series. It is not clear exactly why a pair of needle valves are so effective in damping pressure fluctuations. Although not wishing to be bound by any theory of operation, a theory will be advanced hereinafter. Because the needle valves are adjustable, the size and shape of openings are adjustable. It is clear that opening the needle valves completely reduces their damping effectiveness.

In another aspect of this invention, operation of a downhole motor is monitored and decisions made in response to a pressure differential between the pump pressure supplied at a time when the motor is idling and when the motor is under load. In a typical situation, the motor is equipped with a bit or mill for drilling. When the motor is approaching a stall, or being significantly overloaded, this pressure differential increases in a manner that is recognizable. Stalling a turbine type liquid driven motor is never desirable for a variety of reasons, including wear on resilient parts on the inside of the motor or, as described more fully below, the fatigue on a coiled tubing work string.

It is an object of this invention to provide an improved method and apparatus for monitoring pressure.

Another object of this invention is to provide a method and apparatus for sensing pressure of a source which fluctuates widely and rapidly.

A further object of this invention is to provide applications for pressure monitoring techniques that involve operating downhole tools and equipment in hydrocarbon wells.

These and other objects of this invention will become more fully apparent as this description proceeds, reference being made to the accompanying drawings and appended claims.

DETAILED DESCRIPTION

Figure 1:
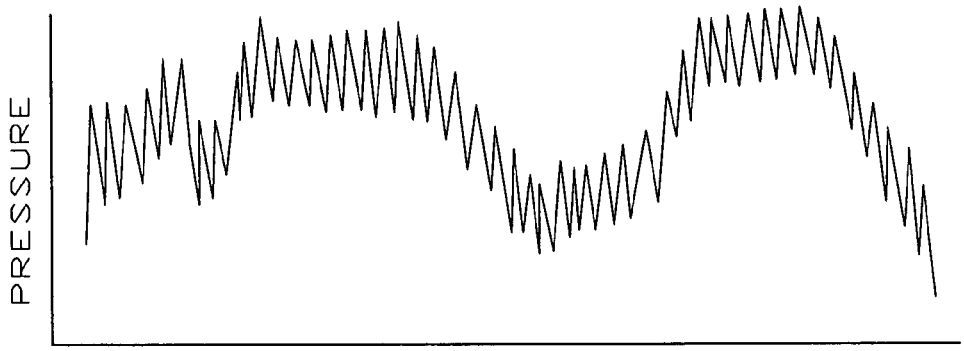
FIG.1 (prior art)
FIG. 1 is a simplified prior art chart of time versus pressure showing the fluctuation of conventional high pressure multiplex pumps.

The discharge pressure of high pressure multiplex pumps used to power or manipulate downhole tools in hydrocarbon wells fluctuates so widely and so rapidly that pertinent pressure changes are often masked by, or are smaller than, the fluctuations. This is illustrated in FIG. 1 which is a graph of time versus pressure taken downstream of a conventional pressure snubber that is supposed to damp pressure fluctuations. Every pump acts slightly differently and the fluctuations vary with the operating speed of the pump and other factors. Basically, however, every time the discharge valve of a high pressure multiplex pump opens, a surge of high pressure liquid leaves the pump producing an upward pressure spike. Because most liquids range from mainly incompressible to slightly incompressible, the pressure surges dissipate as the liquid moves down the flow line into which it is discharged. This causes a reduction in pressure at the pump outlet until the next discharge valve opens.

This invention was developed, and will be described, in conjunction with the operation of so called mud motors, i.e. downhole motors operated by high pressure liquids, gases or mixtures pumped through a work string extending into a hydrocarbon well. These motors will be described using a liquid but it will be understood that gases or mixtures are equally useable. The term mud motor is often misleading because, except in a drilling rig, it is not mud that is pumped down the work string but a liquid, gas or mixture that is clearly not drilling mud. A better name is a hydraulic motor.

It is recognized that this invention has considerable utility in other applications, particularly the operation of other downhole tools, such as the setting of whipstocks, setting of packers, pumping wiper plugs during cementing operations, setting of liners and other situations where downhole tools are operated or manipulated by hydraulic pressure delivered from the surface. In addition, the invention is useful in other operations relating to hydrocarbon wells such as the monitoring of flow from a well which has been recently stimulated. Other applications outside the field of hydrocarbon wells will be apparent to those skilled in the art.

Hydraulic motors are widely used in drilling deviated wells, in completing hydrocarbon wells and in reworking hydrocarbon wells. Many of such motors are of a size and operated on the end of such robust work strings that they and the work strings can take considerable abuse. Hydraulic motors used on coiled or spooled tubing units are in a different category because the coiled tubing work strings are not robust and must be handled with care for a variety of reasons, one of which is to prevent failure due to fatiguing of the metal from which the tubing is made. In addition, mud motors used on coiled tubing strings are usually used inside casing and therefore are typically of smaller diameter and therefore less robust than motors used on drilling rigs.

Referring to FIGS. 2–5, this invention is described in conjunction with a coiled tubing unit being used to drill out a bridge plug, which is a common application of this invention. A typical hydrocarbon well 10 comprises a bore hole 12 drilled into the earth to penetrate one or more hydrocarbon bearing formations 14, 16. A pipe string 18 is cemented in the earth by a cement annulus 20. Perforations 22, 24 have been created to communicate the formations 14, 16 with the inside of the pipe string 18. A bridge plug 26, cement plug 28 and sand bridge 30 have been placed between the formations 14, 16 to isolate them temporarily, as is commonly done during completion of the well 10 where the formations 14, 16 are separately fraced.

A coiled tubing unit 32 of any suitable type is illustrated as suspending a string of coiled tubing 34 in the well providing a hydraulic motor 36 and a bit or mill 38 on the lower end for circulating out the sand bridge 30 and drilling up the cement plug 28 and the bridge plug 26. The coiled tubing 34 is taken off a spool 40 and run over a wheel or arc support 42 and guided by an arcuate support (not shown) and forced into the well 10 by a conventional injection head 44. A typical example of the care given to the treatment of coiled tubing 34 is that the tubing is allowed to cycle over the wheel or arc support 42 only a small number of times because experience has shown this is the location where fatiguing of the metal occurs. The number of cycles before failure is largely a function of pressure inside the coiled tubing and, for example, above 7000 psi, the number of cycles is limited by safety considerations to between ten and twenty. If a cycle limit is reached, the coiled tubing 34 is pulled from the well 10 and a quantity of tubing is cut off the lower end so the next time the tubing is run into the well, a different section of tubing is supported on the wheel 42.

All of this activity is expensive, partly due to the pricing policy of coiled tubing unit owners justified by wear and tear on the coiled tubing 34 and partly due to the time and effort necessary to pull the tubing from the well, detach the bottom hole assembly 36, 38, cut the tubing, reattach the bottom hole assembly and run back into the well. In any event, it is highly desirable to minimize the number of times the coiled tubing 34 is moved over the wheel 42.

When a motor 36 is used on the end of a coiled tubing string 34 to drill up a downhole component in a hydrocarbon well, there are many times when the coiled tubing must be pulled up and down, or cycled, over the wheel 42. A very common occurrence is when too much weight is applied to the motor, as may occur when trying to washout the sand bridge 30 or drill the plugs 26, 28 too rapidly. Relying on conventional pressure readings shown in FIG. 1 is useless either because pertinent pressure information is masked by the fluctuations or because the time delay of prior art equipment results in a tool operating before pressure readings are obtained. Thus, prior art operation of hydraulic motors on the end of coiled tubing is largely a matter of feel, experience and intuition, all of which are difficult and expensive to teach and learn. Much learning comes from failures but failure to pick up the coiled tubing 34 and applying too much weight stalls the motor and potentially damages or ruins it. The lesser evil, i.e. picking up too often on the coiled tubing 34 to slow down drilling, cycles the tubing over the arc support 42 too frequently and fatigues the coiled tubing which must be removed from the well, cut off and run back into the well, at great expense.

Figure 2:
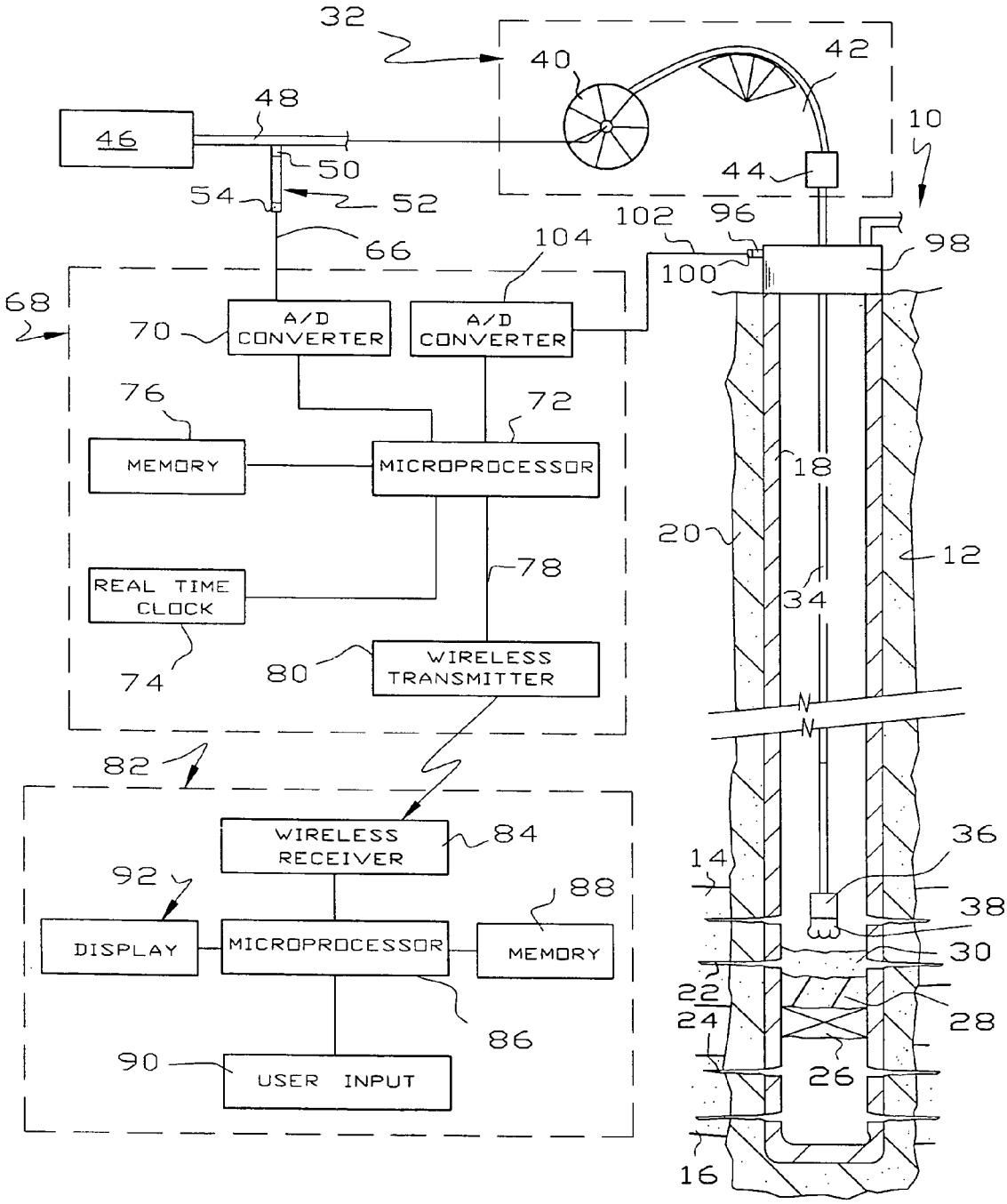
FIG. 2 is a schematic view of the pressure monitoring system of this invention.

As shown in FIG. 2, a pump 46 delivers high pressure liquid through a main flow line 48 into the coiled tubing 34 in a conventional manner. Pressure in the flow line 48 is undamped and fluctuates as shown in FIG. 1. A pressure fitting 50 on the flow line 48 connects to a damper 52 which connects to a suitable pressure sensor 54. The function of the damper 52 is to damp the pressure fluctuations shown in FIG. 1 to an extent that pertinent pump pressure changes are not masked by the fluctuations. Because the damper 52 is not in the main flow line 48, there is no energy loss in the damping process which is typical of situations where the entire flow stream is damped, as in the case of mud pumps on drilling rigs.

To this end, the damper 52 is of a type that damps the fluctuations so they do not exceed 1% of the average pump pressure, preferably so they do not exceed ½ of 1% of the average pump pressure and ideally so they do not exceed 0.2% of the average pump pressure. Thus, on a typical drilling job with a coiled tubing unit where pump pressure may be on the order of 10,000 psi, the fluctuations are damped to be less than 100 psi, preferably less than 50 psi and ideally less than 20 psi.

Figure 4:
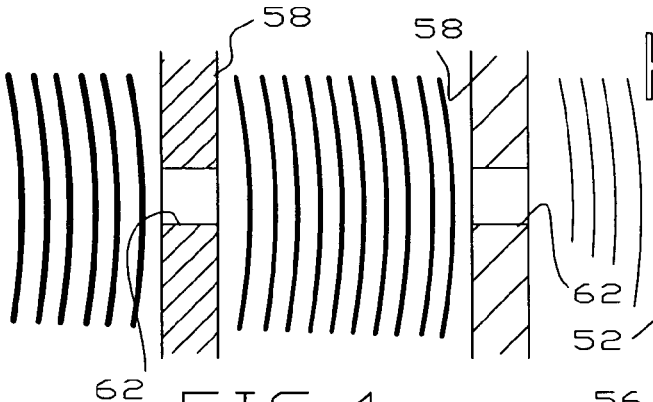
FIG. 4 is a schematic view relating to a theory of operation of the pressure damper.
Figure 3:
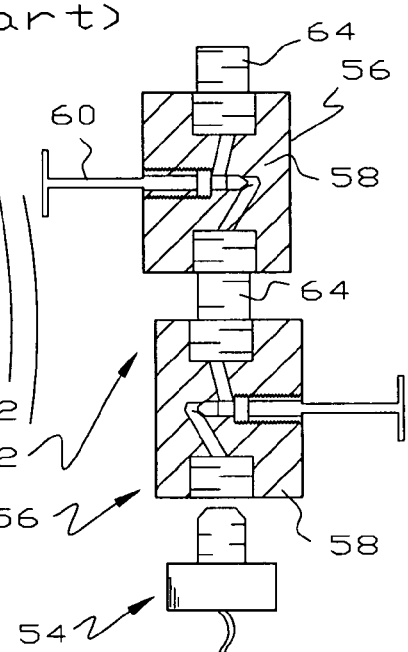
FIG. 3 is an exploded view of the pressure damper and pressure sensor.

Although many designs of dampers may be effective to this extent, a preferred approach is shown in FIGS. 3 and 4 where the damper 52 comprises a pair of conventional needle valves 56 placed in series. The needle valves 56 each comprise a valve body 58 having a rotatable handle 60 for advancing a pointed valve element into and through a passage 62. The housing 58 typically has a male end 64 at one end and female threads in the other end.

Although not being bound by any particular theory of operation, FIG. 4 illustrates what is thought to be happening. On the left or upstream end of FIG. 4, there are large pressure waves suggesting the fluctuations shown in FIG. 1. Between the valve bodies 58 in the flow passage or cavity between the needle valves 56, there is a reduction in the magnitude of pressure waves because the waves have to pass through the small opening 62 of the upstream valve body 58. Downstream of the right or downstream valve body, there are smaller pressure waves than in the cavity between the valve bodies 58 because the pressure waves have to travel through the small opening 62 in the downstream valve body 58. In this fashion, the wildly fluctuating pump pressure of FIG. 1 is damped so substantially that no comparable fluctuations are apparent on the display screen used to show a trace of pump pressure. The effect of the second flow restriction is seen most clearly by reducing the flow passage through the upstream valve, viewing the pressure fluctuations and then reducing the flow passage through the downstream valve. When the first valve is restricted, the pressure pulses seen by the sensor 54 are smaller but still pronounced. Restricting the downstream valve reduces the pressure pulses dramatically to a range of 3–20 psi.

The pressure sensor 54 may be of any suitable type and is conveniently Model MSP-300 obtained from Measurement Specialties, Valley Forge, Pa. This particular sensor is an analog sensor which necessitates the user of an analog-to-digital converter as will be more fully apparent hereinafter.

Referring to FIG. 2, an output 66 from the pressure sensor 54 connects to a data logger assembly 68 which is conveniently portable. The data logger assembly 68 includes an analog-to-digital converter 70 connected to a microprocessor 72. A real time clock 74 provides another input to the microprocessor 72 so that pressure readings obtained from the sensor 54 can be matched with the time when they are taken. The microprocessor 72 may be controlled by suitable software to accept pressure data at predetermined intervals, such as one second or any other suitable interval. A memory device 76 is provided to temporarily store data. An output 78 from the microprocessor 72 operates a transmitter 80 to deliver time/pressure data to a graphical display assembly 82. The transmitter 80 is preferably wireless using convenient technology such as a low power radio frequency approach.

The graphical display assembly 82 may be of any suitable type, such as a computer screen or a special purpose, display of a size small enough to carry easily. The display assembly 82 comprises a receiver 84 receiving communication from the transmitter 80, a microprocessor 86, a memory device 88, a user input 90 and a display 92. The display 92 is typically a computer monitor or other suitable electronically manipulated screen. It will accordingly be seen that time/pressure data from the transmitter 80 passes through the receiver 84 into the microprocessor 86 and is stored in the memory device 88. The microprocessor 86 delivers data to the display 92 at suitable intervals to construct a time/pressure trace 94, as shown in FIG. 5, indicative of damped pressure readings from the sensor 54.

In coiled tubing operations of the type described, it is often desirable to know the pressure at the surface in the annulus between the coiled tubing 34 and the pipe string 18. To this end, a pressure fitting 96 is attached to the wellhead 98 and provides a pressure sensor 100 having an output 102 connected to an analog-to-digital converter 104 in the data logger assembly 68. Pressure in the annulus measured by the sensor 100 typically does not fluctuate significantly so no damper is necessary. The components of the assembly 68 are sufficiently capable to accommodate additional data, so the data transmitted to the graphical display device assembly 82 includes a stream of time/pressure information indicating pressure in the annulus. This data is stored in the memory device 88 and shown on the display 92 as a second trace 101, as shown in FIG. 5.

The absolute value of the pressure in the annulus normally depends on the size of the choke (not shown) used to control flow from the well 10. The absolute value of the pressure in the annulus, unless the well is blowing out, is typically less than the pump pressure measured by the sensor 54. The scale of the pressure trace 101 is thus typically much lower than the scale of the trace 94, meaning that the display 92 may simultaneously show two separate pressure scales. In a typical bridge plug drilling operation, the pressure trace 94 may be shown on a scale of 6000–8000 psi while the pressure trace 101 may be on a scale of 1000–3000 psi as shown by suitable lines and/or indicia (not shown) on the display 92. The microprocessor 86 detects when pressure readings rise above or below the scale being used on the display 92 and adjusts the scale accordingly by shifting the scale up or down to make room for the trace. Similarly, when the traces 94, 101 approach the right side of the display 92, the pressure traces 94, 101 are shifted to the left to provide room for additional data.

Figure 5:
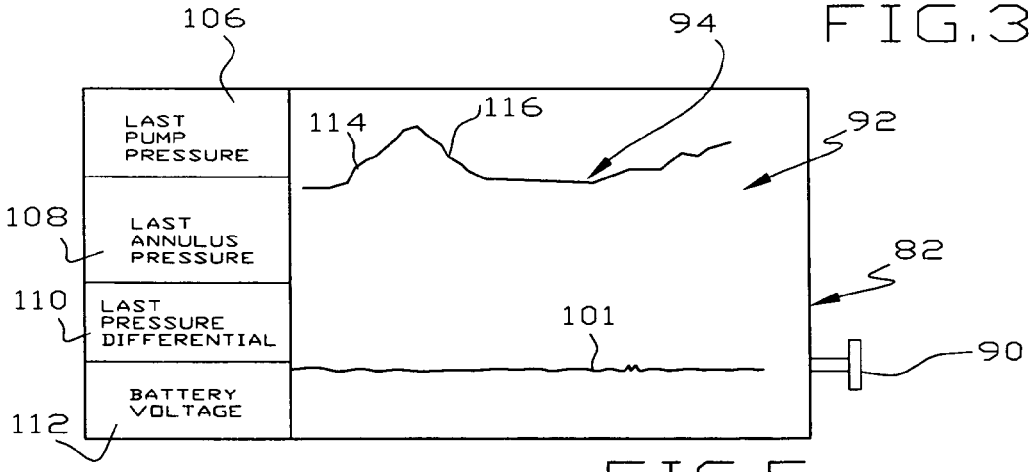
FIGS. 5 and 6 are pictorial views of a display of this invention.

The display 92, as shown in FIG. 5, also preferably provides a series of boxes on one side. The box 106 conveniently shows the last pump pressure reading, the box 108 shows the last annulus pressure reading, the box 110 shows the last pressure differential reading as will be explained more fully hereinafter and the box 112 shows a voltage reading of the battery (not shown) used to operate the graphical display assembly 82 and thus suggests when the battery needs to be replaced.

An important feature of this invention is that the pressure traces 94, 101 and the values in the boxes 106–112 are in real time, i.e. current time/pressure data being captured by the microprocessor 72 shows up as an addition to the traces 94, 101 in short order, typically in a second or two. Thus, the person in charge of the operation and the person controlling the pump 46 and the injection head 44 have the capability of watching real pump and return pressures in real time and adjust operation of the pump 46 and or the coiled tubing unit 32 in response to events as they occur. Often, the trend of the pressure curves provides important clues about what is happening in the well 10 and allows the users to adjust in response to conditions as they occur and are reflected in pump and return pressure. For example, if coiled tubing 34 is being fed into the well 10 at the depth of the sand bridge 30, a rise in pump pressure at 114 indicates that the torque on the motor has increased and, in this context, typically means that weight is being applied to the bit 38 and the subsequent fall in pump pressure at 116 indicates that the sand bridge 38 is being washed away or being drilled.

Often, the relationship between the trends in pump and return pressure suggests an explanation for events that are occurring in the well 10. For example, if both pressure traces 94, 101 are falling slightly at a time when washing or drilling a plug, it likely means a lower pressure zone has been exposed. The exact meaning of any pressure changes seen on the display 92 will always depend on the context of what is happening.

As suggested previously, an important application of this invention is in operating a hydraulic motor used in a drilling application, such as shown in FIG. 2. As mentioned previously, too much weight on the bit 38 causes increased load on the motor 36 and ultimately causes it to stall. In the prior art, when the motor is in the process of stalling, it is not apparent until the pump outlet pressure rises dramatically which occurs well after the motor has stalled. What is difficult is detecting when the motor is beginning to stall. The delay in realizing the motor has stalled is aggravated because the fluctuations in pump pressure are greater than the pressure variation that indicates the motor has stalled. For example, the fluctuations shown in FIG. 1 can easily be 300–500 psi when the average pump pressure is 7000 psi, i.e. the fluctuations can easily be in the range of 5–10% of the average pump pressure.

When a hydraulic motor goes from an idling condition to a loaded condition, there is a pressure increase on the inlet side of the motor because the motor is loaded and the force generated by the motor is converted from the pressure drop across the motor. When a hydraulic motor stalls, the pressure at the motor inlet increases further. The motor inlet pressure that signals stalling depends on the size of the motor, how much the motor is worn and a variety of other factors, many of which change while a motor is being used and before it is retrieved from a well.

Figure 6:
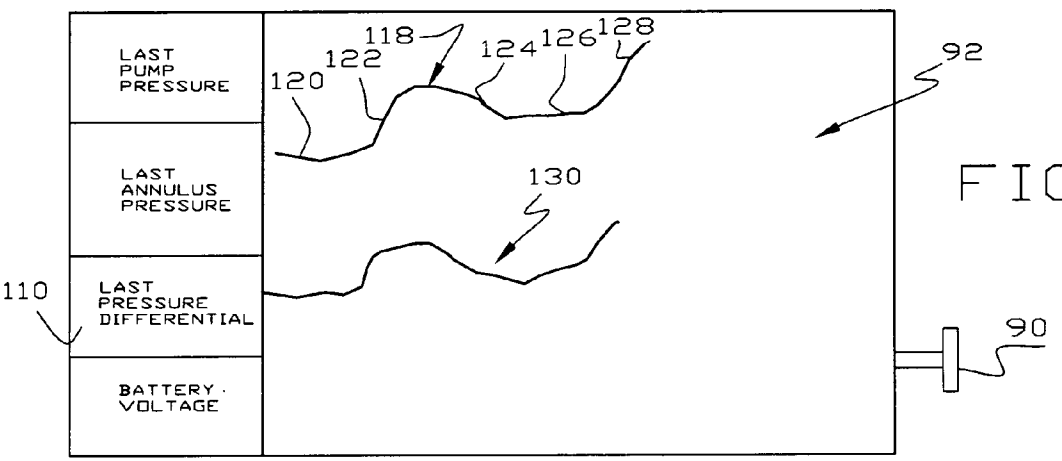

Referring to FIG. 6, a pressure trace 118 is a typical example of what happens to pump pressure as the bit 38 is lowered onto a solid drillable object, such as the cement plug 28 or the bridge plug 26. At the outset, as at 120, the motor 36 is idling and the pump pressure is relatively stable over time. As the bit 38 is lowered onto the cement plug 28, the pump pressure rises as shown at 122 suggesting the bit 38 is loaded and drilling on the cement plug 28. Often, the bit 38 will drill off, i.e. it will drill faster than it is being lowered, and the pump pressure will decline slightly as shown at 124 and ultimately stabilize at 126 where the coiled tubing 34 is being lowered at the same rate as the cement plug 28 is being drilled. It will be seen that the absolute pressure in the region 126 is higher than in the region 124 indicating that the motor 36 is under load, which is what one would expect when the motor 36 goes from idling to under load.

In the event the coiled tubing 34 is lowered too rapidly, the pump pressure rises as at 128, suggesting an imminent stalling of the motor 36. At this time, the coiled tubing operator would manipulate the injection head 44 to either quit lowering the coiled tubing 34 or raise the coiled tubing 34 to quit drilling. The pressure necessary to stall a motor 36 of the type used on coiled tubing units 32 varies somewhat but a 200 psi pressure rise would be sufficient in many cases to stall the motor. Such a pressure rise is well below the fluctuations inherent in a high pressure multiplex pump so it would be completely masked to the coiled tubing unit operator.

In one aspect of this invention, the differential pressure is displayed in box 110 or a trace 130 of differential pressure is provided to assist in detecting an incipient stall of the motor 34. The differential pressure displayed in box 110 or the trace 130 is a pressure differential $P_2-P_1$ where $P_1$ is the pressure when the motor 36 is idling and $P_2$ is the instantaneous pressure of the motor 36. To set the differential pressure trace 130 and to zero the instantaneous pressure differential shown in box, the user input 90, shown as a depressible button in FIGS. 5 and 6, is depressed at a time when the motor 36 is idling, i.e. during the interval 120 on trace 118. This sets a value for $P_1$ until the next time the user input 90 is actuated.

The pressure trace 130 will be seen to be an exaggeration of the pressure trace 118 over short intervals of time unless the scale of the trace 118 is itself exaggerated. Thus, experienced users of this invention are capable of using the pressure traces 94, 118 to determine the onset of motor stall and take appropriate action without use of the trace 130.

Typically however, when the motor 36 begins to stall, for whatever reason but typically due to too much weight on the bit 38, the coiled tubing operator makes decisions based on the trace 118 or the trace 130 to take weight off the bit 38 either by stopping or slowing the lowering of the coiled tubing 34 into the well or by raising the coiled tubing 34 if necessary. It will be seen that using the trace 118 or the trace 130 allows the coiled tubing operator to reduce the number of times the coiled tubing 34 is raised, thereby reducing the cycling of the coiled tubing over the wheel 42.

This is an important advance in the operation of coiled tubing units because it reduces cycling of the coiled tubing and reducing unnecessary wear on downhole hydraulic motors thereby reducing the costs of coiled tubing operations.

Figure 7:
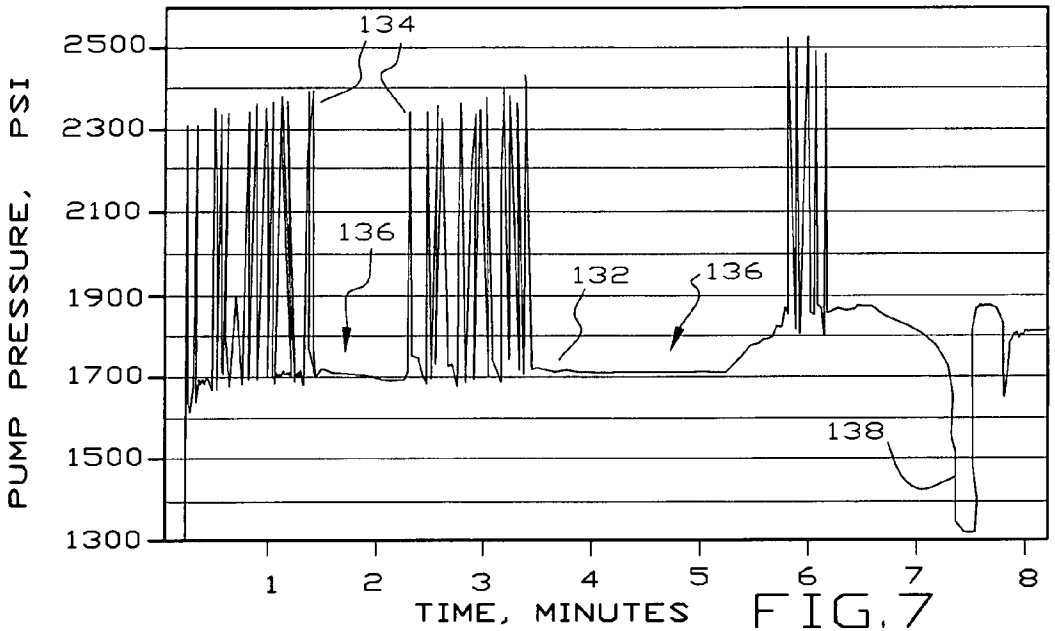
FIG. 7 is a graph illustrating the effectiveness of this invention.

Referring to FIG. 7, there is illustrated a test of a turbine motor drilling a window in casing after a whipstock was set. This test was conducted in a test jig located at the surface so the absolute pressure values are much lower than would be expected in a downhole application where the surface pump has to overcome the hydrostatic pressure of the motive fluid. A characteristic of a turbine motor is that when it stalls, the motive fluid basically bypasses the turbine so the surface pump pressure falls off substantially. The pump was run continuously for slightly more than eight minutes.

FIG. 7 provides a single trace 132 of pump pressure and illustrates several areas 134 where the damping valves 56 of this invention have been intentionally opened so the damping system is not operative and several areas 136 where the damping valves 56 have been manipulated to provide substantial damping. It will be seen that the pressure fluctuations in the undamped areas 134 is in the neighborhood of 600 psi and the pressure fluctuations in the areas 136 are barely discernable on the scale shown and are in the range of 3–20 psi. Just after the turbine motor stalls, the pump pressure falls off. When weight is taken off the bit, the turbine begins drilling and the pressure returns to a more normal value, as shown at area 138.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

We claim:

1. A method of monitoring operations of a downhole tool of the type that is positioned in a hydrocarbon well and operated by hydraulic pressure supplied from above ground by a pressure source having a fluctuating outlet pressure providing fluctuations of a size that mask pressure responses of operation of the downhole tool, comprising:

providing a pressure sensing line leading from the pressure source;

damping pressure in the pressure sensing line to reduce fluctuations therein to a value that pertinent pump pressure changes are not masked by the fluctuations to thereby reveal operation of the downhole tool;

sensing damped pressure and providing an output; and displaying a real time trace of damped pressure.

2. The method of claim 1 wherein the pressure is hydraulic pressure.

3. The method of claim 1 wherein the tool is a motor.

4. The method of claim 1 further comprising:

determining a series of pressure differential values equal to the outlet pressure of the pressure source when the downhole tool is inoperative and a series of outlet pressures of the pressure source when the downhole tool is under load; and displaying a value, in real time, representative of the pressure differential.

5. The method of claim 4 wherein the displaying step comprises displaying a trace of the pressure differential versus time.

6. The method of claim 1 wherein the damping step comprises damping pressure in the pressure sensing line to a value smaller than pertinent pump pressure changes.

7. The method of claim 6 wherein the damping step comprises damping pressure in the pressure sensing line to a value between 0.2%–1% of average pump pressure.

8. A monitoring system for a downhole tool powered by liquid pumped down a work string in a hydrocarbon well by a pressure source having a fluctuating outlet pressure providing fluctuations of a size that mask pressure responses of the downhole tool, comprising:

a pressure sensing line leading from the pressure source;

a pressure damper in the pressure sensing line to reduce fluctuations therein to a value that pertinent pump pressure changes are not masked by the fluctuations to thereby reveal operation of the downhole tool; and a display connected to the pressure damper for displaying a real time trace of damped pressure and for displaying a real time pressure differential equal to the outlet pressure of the pressure source when the downhole tool is inoperative and the outlet pressure of the pressure source when the downhole tool is under load.

9. The monitoring system of claim 8 wherein the pressure differential is displayed on the display device as a trace of real time versus pressure.

10. The monitoring system of claim 8 wherein the pressure damper has the capacity to reduce fluctuations in the pressure sensing line to reduce fluctuations to a value smaller than pertinent pump pressure changes.

11. The monitoring system of claim 10 wherein the pressure damper has the capacity to reduce fluctuations in the pressure sensing line to reduce fluctuations therein to a value between 0.2%–1% of average pump pressure.

* * * * *